United States Patent [19]

Itami et al.

[11] 4,449,831

[45] May 22, 1984

[54] PENDULUM ARRANGEMENT FOR CLOCK MOVEMENT

[75] Inventors: Masaru Itami, Nagano; Kunio Tatusawa, Saitama, both of Japan

[73] Assignee: Rhythm Watch Co., Ltd., Tokyo, Japan

[21] Appl. No.: 402,585

[22] Filed: Jul. 28, 1982

[30] Foreign Application Priority Data

Jul. 31, 1981 [JP] Japan ..... 56-114215[U]
Jun. 3, 1982 [JP] Japan ..... 57-82534[U]

[51] Int. Cl.³ ..... G04F 5/00; G04B 15/00

[52] U.S. Cl. ..... 368/165; 368/134; 368/179

[58] Field of Search ..... 368/134–139, 368/165, 166, 179

[56] References Cited

U.S. PATENT DOCUMENTS 3,411,288 11/1968 Koplar et al. ..... 368/134
4,127,986 12/1978 Nozawa et al. ..... 368/137
4,139,981 2/1979 Nozawa et al. ..... 368/139
4,228,533 10/1980 Siefert ..... 368/134
4,378,166 3/1983 Itami et al. ..... 368/134

FOREIGN PATENT DOCUMENTS 3001951 7/1980 Fed. Rep. of Germany ..... 368/134

*Primary Examiner*—Bernard Roskoski
*Attorney, Agent, or Firm*—Koda and Androlia

[57] ABSTRACT

A pendulum arrangement for a clock movement in which such arrangement has a pendulum arm being mounted to swing freely at a pendulum arm supporting means which is installed on a clock movement housing, and said pendulum arm supporting means consists of a pendulum arm supporter which is pivotally held with free rotation on the clock movement housing so that the pendulum arm supporter can rotate and adjust its supporting position in accordance with the swinging state of the pendulum arm in the inclination of the clock movement.

4 Claims, 21 Drawing Figures

PENDULUM ARRANGEMENT FOR CLOCK MOVEMENT

BACKGROUND OF THE INVENTION

1. Field of the Invention

This invention relates to a pendulum arrangement for a clock movement, and more particularly to a bearing device for a pendulum arm.

2. Description of the Prior Art

The pendulum arrangement for the clock movement has conventionally formed one of the important portions of pendulum clocks as a time standardizing oscillator and has been widely used for decoration even in the modern electronic clock in which a crystal oscillator or the like is installed.

This known pendulum arrangement has a pendulum arm supporting means 10, as shown in FIG. 1, which is provided on a clock movement housing so that a pendulum arm 12 swings freely. In FIG. 1 the pendulum supporting means has a V-shape groove 10*a* in which a knife edge 12*a* of the pendulum arm 12 is supported. A pendulum 14 is provided at the lower end of the pendulum arm 12, but the swinging movement of the pendulum arm 12 and the pendulum 14 continues by the electromagnet driving force produced between a magnet 16 and a coil 18 which is attached on the clock movement housing. The swinging state of the pendulum arm 12 is shown by chain lines in the Figure.

In FIG. 2 shown therein is a supporting state between the pendulum arm supporting means 10 and the pendulum arm 12 when the clock movement is set in the vertical line in the right way. As is evident from Figure, the pendulum arm 12 can swing an equal angular amount $\theta$ in both directions and this angular amount $\theta$ is determined to be larger than the ordinary swinging angular amount of the pendulum arm.

Accordingly, in an ordinary state the swinging movement of the pendulum arm 12 and the pendulum 14 can be obtained in good conditions. This known prior art pendulum arrangement, however, has the disadvantage that the pendulum movement cannot be performed properly or at all when the clock movement is set on an inclined surface.

In FIG. 3 shown therein is a state that the clock movement or the supporting means 10 is set at an inclination $\theta_0$ relative to the perpendicular line. At this time, as evident from Figure, in a swing to one direction, that is, to a clockwise direction in Figure, the pendulum arm is limited in its swing angular amount to the amount $(\theta\text{-}\theta_0)$. The pendulum arm 12, therefore, comes in touch with the V-shape groove 10*a* of the supporting means 10 so that it swings in an unstable state or cannot swing at all.

SUMMARY OF THE INVENTION

Accordingly, it is an object of the present invention to provide a pendulum arrangement for a clock movement in which a pendulum arm can swing in good condition in spite of any set angle of the clock movement.

In keeping with the principles of the present invention, the object is accomplished with a pendulum arrangement for a clock movement in which such arrangement has a pendulum arm being mounted to swing freely at a pendulum arm supporting means which is installed on a clock movement housing, and said pendulum arm supporting means consists of a pendulum arm supporter which is pivotally held wtih free rotation on the clock movement housing so that the pendulum arm supporter can rotate and adjust its supporting position in accordance with the swinging state of the pendulum arm.

DETAILED DESCRIPTION OF THE PREFERRED EMBODIMENTS

Figure 1:
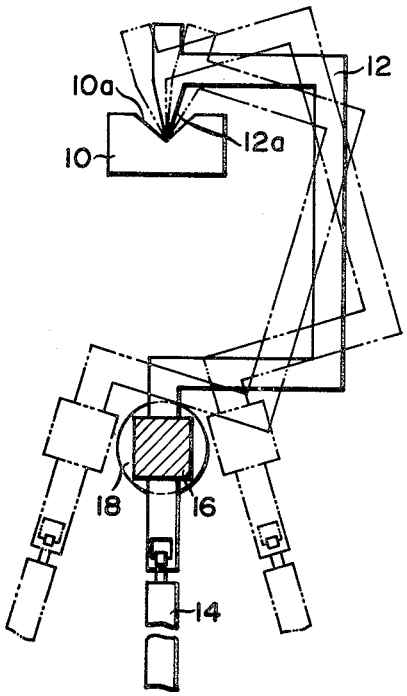
FIG. 1 PRIOR ART
FIG. 1 is an illustration showing a pendulum arrangement in the prior art.
Figure 4:
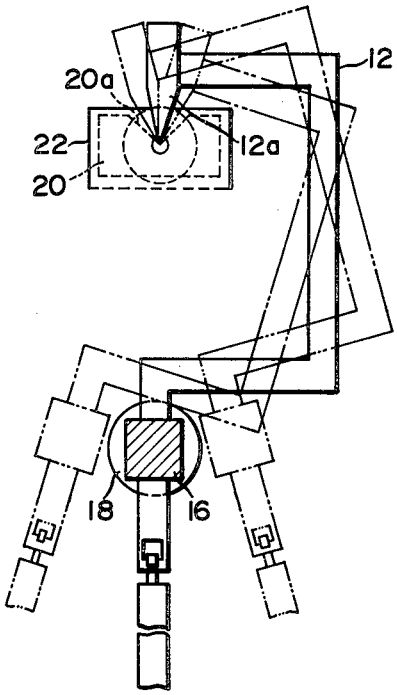
FIG. 4 is an illustration showing the first preferred embodiment of the pendulum arrangement in accordance with the teachings of the present invention.
Figure 5:
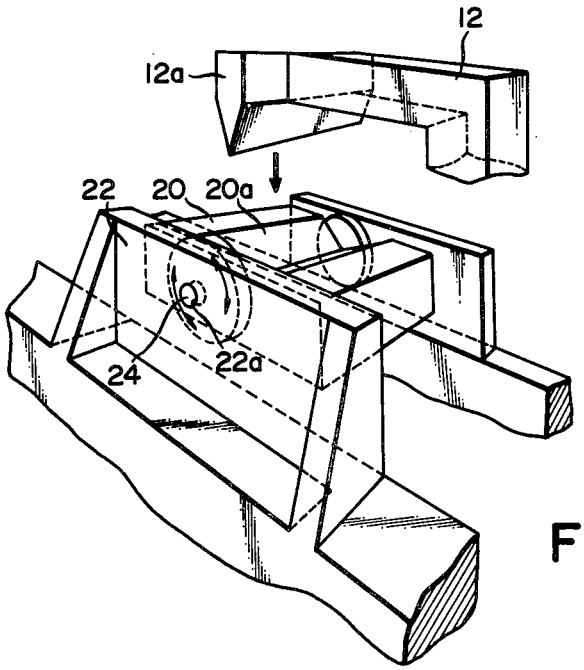
FIG. 5 is an enlarged perspective view of a pendulum arm supporting means in FIG. 4.

In FIG. 4 shown therein is the first preferred embodiment of decoration pendulum arrangement in accordance with the teachings of the present invention. The like elements in FIG. 1 are denoted the like numerals, and the description will be omitted.

In the present invention the pendulum arm supporting means 10 consists of a pendulum arm supporter 20 which is pivotally mounted with free rotation on the clock movement housing, and the pendulum arm supporter 20 is pivotally mounted by a supporter holder 22.

The pendulum arm supporter 20 in this embodiment is pivotally mounted as shown in the enlarged perspective view of FIG. 4.

The pendulum arm supporter 20 has a V-shape groove 20*a* on its upper surface in the same way as shown in the prior art to receive a knife edge 12*a* of the pendulum arm 12, and the shafts 24 prepared on its both ends are pivotally mounted by bearing holes 22*a* of the supporter holder 22 which is solidly molded with the clock movement housing. Accordingly, the pendulum arm supporter 20 can be freely rotated around the shafts 24 to be centered as shown by an arrow.

Figure 7:
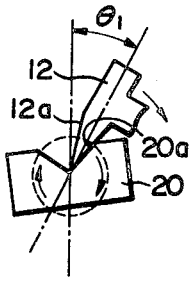
Figure 8:
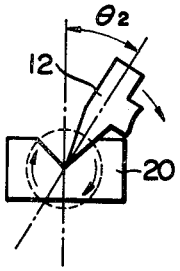

As described above, according to the first embodiment of the present invention, the pendulum arm can be automatically controlled by the pendulum arm supporting means 10 in case of the clock movement is set at an inclination since the pendulum arm supporter 20 is rotably provided on the clock movement housing. The operation of the automatic control mentioned above is illustrated in FIGS. 6, 7 and 8.

Figure 6:
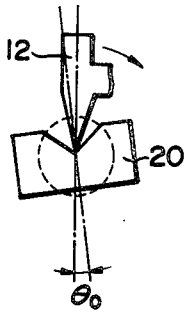
FIGS. 6, 7 and 8 are illustrations to describe the operation of the first embodiment.

In FIG. 6 shown therein is a state in which the clock movement is inclined and set at $\theta_0$ angle from the vertical line. At this time the pendulum arm supporter 20 is also inclined together with the clock movement as shown in the Figure. When the pendulum arm starts swinging in this state to move in the predetermined swinging angular amount, in other words, when the pendulum arm rotates to the angle at which the knife edge 12*a*of the pendulum arm 12 and the V-shape groove 20*a* of the pendulum arm supporter 20 come in touch with each other, the pendulum arm supporter 20 is rotated by the pendulum arm 12*a* as shown by the arrow and the pendulum arm 12 swings up to its requested swinging angle $\theta_2$. Accordingly, in this state the pendulum arm supporter 20 automatically sets its angle from its initially inclined place to a requested position and the pendulum arm 12 can be firmly prevented from unstable or impossible swinging caused by contact between the pendulum arm 12 and the pendulum arm supporting means, which happened in the prior art device.

Figure 9:
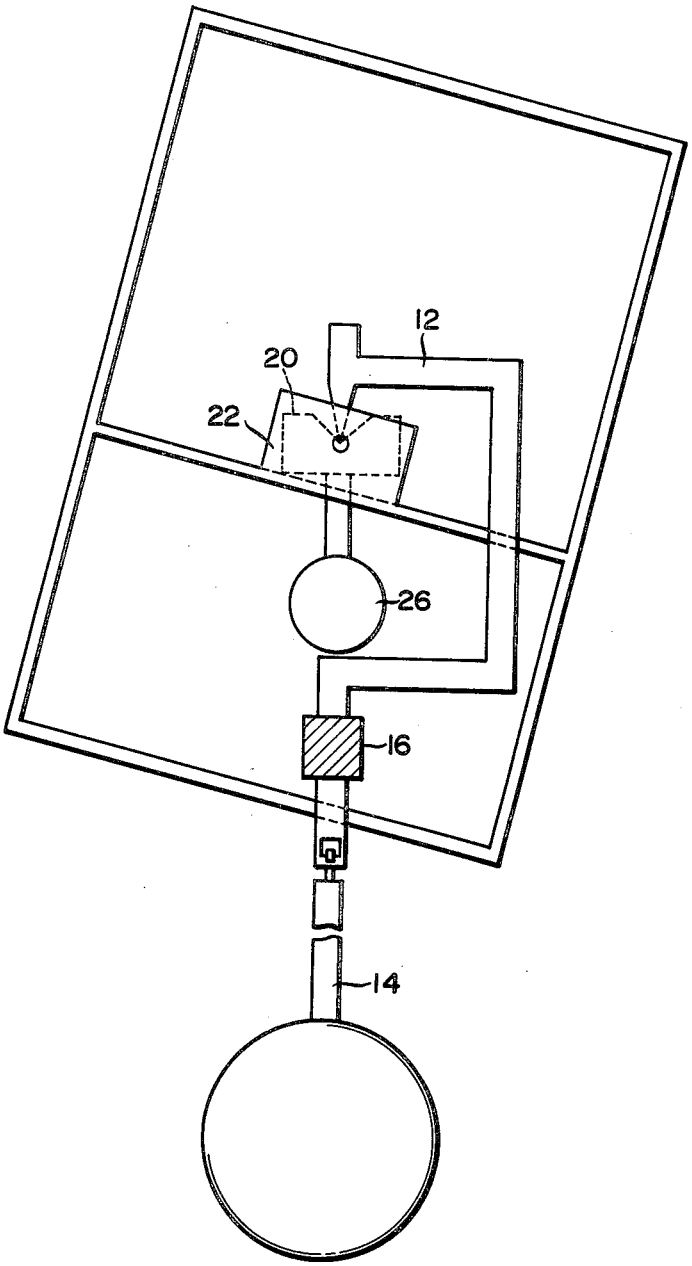
FIG. 9 is an illustration showing the second embodiment of the present invention.

In the first embodiment described above, the rotating adjustment of the pendulum arm supporter 20 is performed when the pendulum arm 12 starts swinging and comes in tough with the pendulum arm supporter 20. In the second embodiment of the present invention shown in FIG. 9, however, the rotating adjustment is performed as soon as the clock movement is set. In other words, in the second embodiment a weight 26 is fixed under the pendulum arm supporter 20 so that the pendulum arm supporter 20 can be always stabilized on its perpendicular line. When the clock movement is set with inclination as illustrated in FIG. 9, the pendulum arm supporter 20 is automatically rotated and adjusted right on to the perpendicular line of the weight 26 without waiting for the swinging of the pendulum arm 12.

Figure 10:
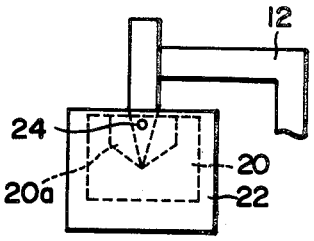
FIG. 10 is an illustration showing the third embodiment of the present invention.
Figure 11:
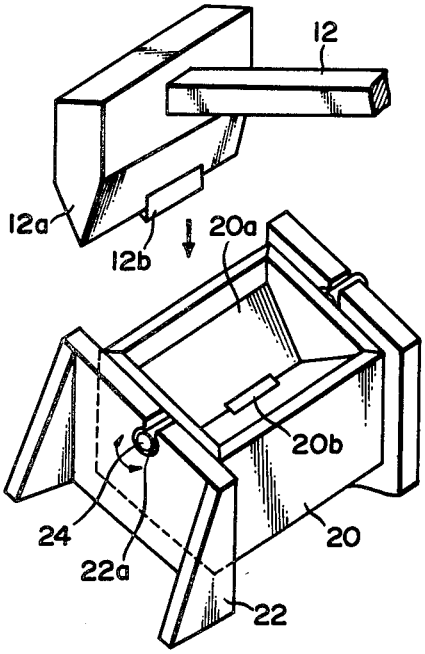
FIG. 11 is a perspective view showing the pendulum arm supporting means of the third embodiment.

In FIGS. 10 and 11 shown therein is the third embodiment. The like elements in the previously explained embodiments are denoted like numerals, and the description will be omitted.

In the third embodiment the pendulum arm supporting point of the pendulum arm supporter 20 is determined lower than the rotating center of the pendulum arm supporter 20. In other words, the bottom of the V-shape groove 20*a* of the pendulum arm supporter 20 is prepared lower than the shafts 24, and the center of gravity of the pendulum arm 12 and the pendulum is added to the pendulum arm supporter 20 in the same way as the weight 26 described with FIG. 9 in such state that the pendulum arm 12 is held by the pendulum arm supporter 20. Consequently, the pendulum arm supporter 20 can be rotated and adjusted to the predetermined position with extreme ease.

Figure 12:
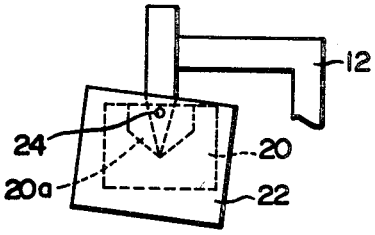
FIG. 12 is an illustration to describe the operation of the third embodiment.

FIG. 12 describes that, even in such state that the clock movement, that is, the supporter holder 22 is set with inclination, the pendulum supporter 20 can be immediately rotated and adjusted on to the perpendicular line of the supporter 20 with the pendulum arm 12 placed on the pendulum arm supporter 20. .

Furthermore, as shown in FIG. 11, a projected portion 12*b* is prepared in the center area of the knife edge 12*a* of the pendulum arm 12. This projected portion 12*b* engages in a gutter 20*b* made in the bottom of the V-shape groove 20*a* so that the pendulum arm 12 cannot move along the axis of the knife edge 12*a* in the pendulum arm supporter 20.

Figure 13:
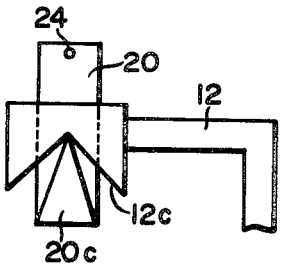
FIG. 13 is an illustration showing the fourth embodiment of the present invention.

In FIG. 13 shown therein is the fourth embodiment of the present invention. In this embodiment the pendulum arm supporter 20 has the knife edge 20*c* and the pendulum arm 12 is prepared with the V-shape groove 12*c*. In this embodiment the pendulum arm is supported by the pendulum arm supporter 20, which can be freely rotated and adjusted in accordance with set conditions of the clock movement.

In the fourth embodiment, the supported point of the pendulum arm 12 by the pendulum arm supporter 20 is also determined lower than its rotating axis, and the rotating adjustment can be performed without neccesity of the additional weight.

As described hereinabove, according to the present invention, the pendulum arm supporter can be automatically rotated and adjusted to the right position in order for the pendulum arm to obtain the requested swinging angles at any set position of the clock movement, and the handy pendulum arrangement for the clock movement can be easily obtained.

Figure 2:
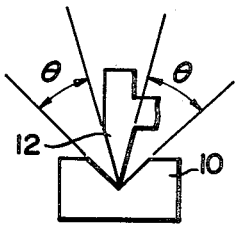
FIG. 2 PRIOR ART
FIGS. 2 and 3 are illustrations to describe the operation of FIG. 1.
Figure 3:
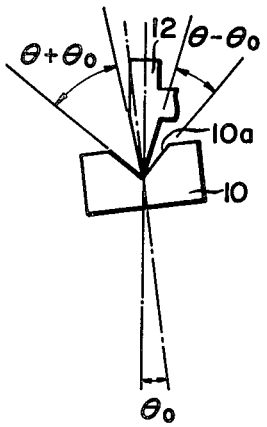
FIG. 3 PRIOR ART

In the prior art device, a driving coil 18 is placed on one side out of the swinging center of the pendulum arm 12 as shown in FIGS. 1–3 when the clock movement is set with inclination. Consequently, a magnet 16 passes over the driving coil 16 in inbalanced amount to the left or the right and the relative passing amount of the magnet 16 passing over the driving coil 18 is decreased so much that the electromotive force is decreasingly induced in the driving coil 18 and the amplitude of the pendulum arm 12 decreases. The decreased amplitude of the pendulum arm 12 makes the magnet 16 pass over the driving coil 18 in a slow speed to increase the electric current consumption in the driving coil 18.

In the pendulum arrangement for the clock movement including the pendulum arm supporting means prepared on the clock movement housing, the pendulum arm held by the pendulum arm supporting means for free swinging, an electromagnet driving plate being prepared on the clock movement housing and having the driving coil or the magnet, and the magnet or the driving coil fixed on the pendulum arm in order to produce the swinging force to the pendulum arm by means of electromagnetic coupling with either of the magnet or the coil that is fixed to the pendulum arm, the pendulum arm supporting means consists of the pendulum arm supporter which is pivotally mounted with free rotation on the clock movement housing and the electromagnetic driving plate is pivotally mounted with free rotation against the clock movement so that the pendulum arm supporter is rotated and adjusted its supporting position in accordance with its supporting position of the pendulum arm and the electromagnetic driving plate is rotated and adjusted its electromagnetic coupling position in accordance with its swinging state of the pendulum arm, when the clock movement is set with inclination.

In FIG. 4 shown therein is the fifth embodiment of the pendulum arrangement for the clock in accordance with the teachings of the present invention.

Figure 14:
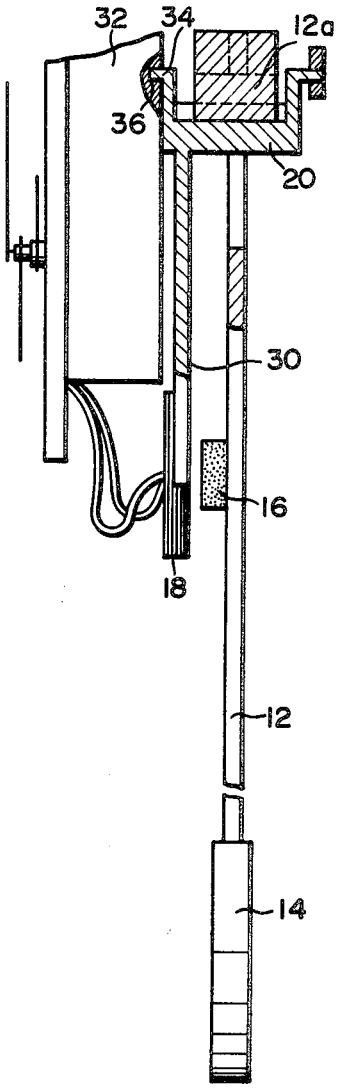
FIG. 14 is an illustration showing the fifth embodiment of the present invention.

In this embodiment the pendulum arm supporting means consists of the pendulum arm supporter which is pivotally mounted with free rotation on the clock movement housing and the electromagnetic driving plate is pivotally mounted with free rotation against the clock movement. In the fifth embodiment the pendulum arm supporter 20 and the electromagnetic driving plate 30 are solidly molded, and pivotally mounted with free rotation on the same axis fulcrum with the clock movement as shown in FIG. 14. In other words, the pendulum arm supporter 20 has the shaft 34 while the clock movement has the bearing hole 36 engaging with the shaft mentioned above, and the pendulum arm supporter 20 and the electromagnetic driving plate 30 can rotate to the bearing hole 36.

In the fifth embodiment, therefore, the pendulum arm supporter 20 and the electromagnetic driving plate 30 are determined to stay right on their perpendicular line by their own weight, and are immediately adjusted to the right place by automatic rotation without any swinging of the pendulum arm 12, when the clock movement is set with inclination. Consequently, the swinging operation of the pendulum arm 12 is obtained in good conditions when the clock movement 32 is set with inclination.

Figure 15:
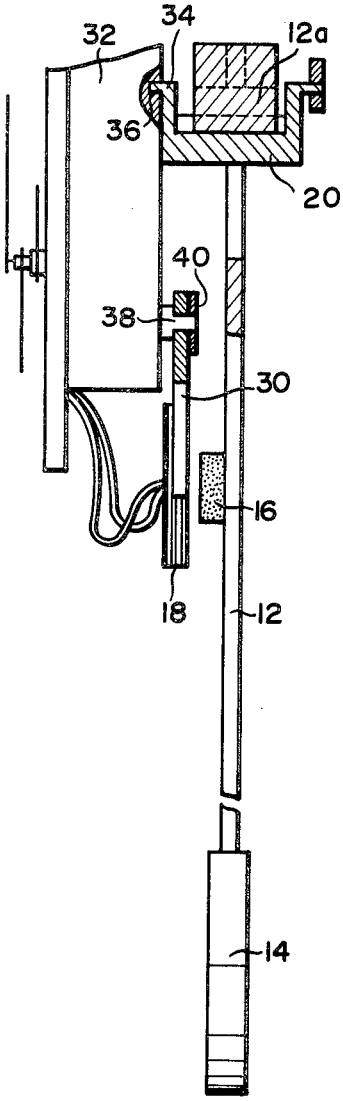
FIG. 15 is an illustration showing the sixth embodiment of the present invention.

In FIG. 15 shown therein is the sixth embodiment of the present invention. In the sixth embodiment that the pendulum arm supporter 20 and the electromagnetic driving plate 30 are separately formed and pivotally mounted with free rotation to separate axis fulcrums of the clock movement 32. In other words, the pendulum arm supporter 20 has the shaft 34, and the clock movement has the bearing hole 36 which is engaged with the shaft mentioned above. The pendulum arm supporter 20 can be rotated to the bearing hole 36 by its own weight. Furthermore, the clock movement 32 has another shaft 38, and the electromagnetic driving plate 30 is formed the bearing hole 40 which engages with the shaft 38 mentioned above. The electromagnetic driving plate 30 is adjusted its position by its own weight. Accordingly, in the sixth embodiment the pendulum arm 12 can be obtained its swinging operation in good conditions when the clock movement 32 is set with inclination.

Figure 16:
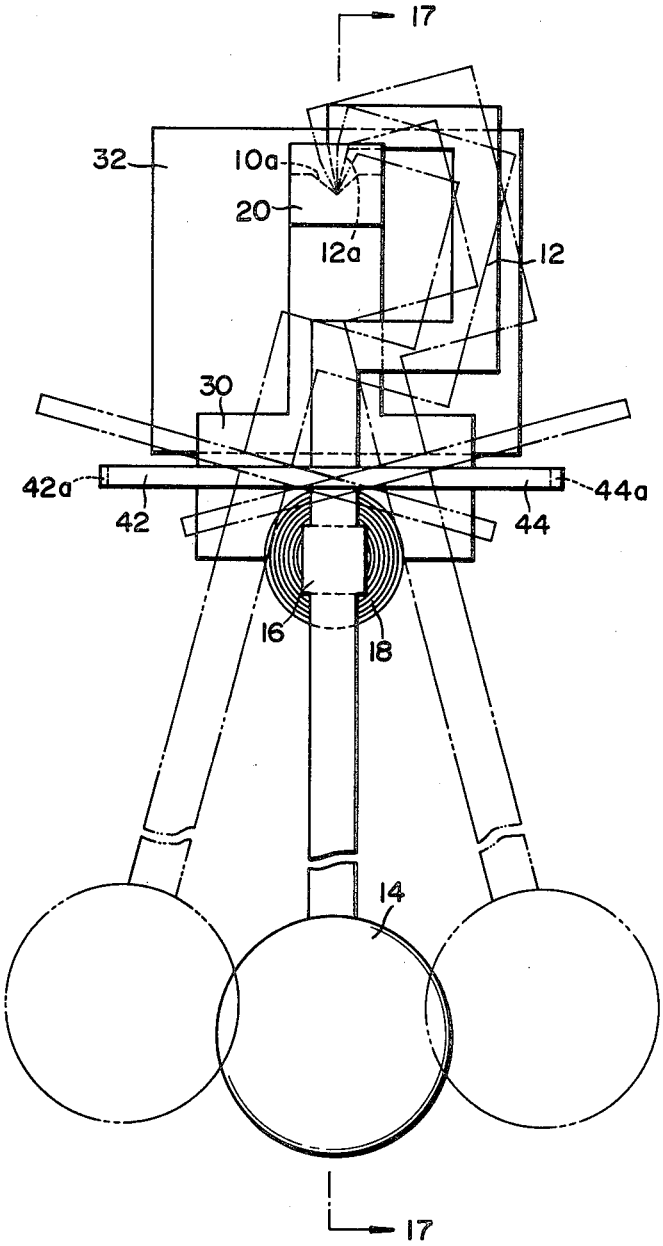
FIG. 16 is an illustration showing the seventh embodiment of the present invention.
Figure 17:
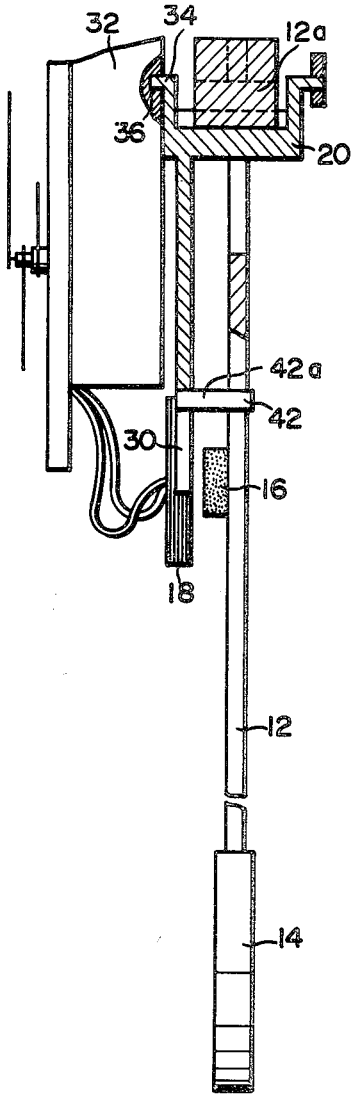
FIG. 17 is a sectional view taken on line 17—17 of FIG. 16.

In FIG. 16 shown therein is the seventh embodiment of the pendulum arrangement for the clock in accordance with the teachings of the present invention, and FIG. 17 is its sectional view.

In this embodiment, as described in the fifth embodiment, the pendulum arm supporting means consists of the pendulum arm supporter which is pivotally mounted with free rotation on the clock movement housing, and the electromagnetic driving plate is pivotally mounted with free rotation against the clock movement. In Figures the pendulum arm supporter 20 and the electromagnetic driving plate 30 are solidly molded, and are pivotally mounted with free rotation on the same axis fulcrum with the clock movement 32. In other words, the pendulum arm supporter 20 has the shaft 34 and the clock movement 32 has the bearing hole 36 which engages with the shaft 34 mentioned above. The pendulum arm supporter 20 and the electromagnetic driving plate 30 can be rotated to the bearing hole 36.

Furthermore, in the seventh embodiment, the pendulum arm 12 has contact arms 42 and 44 which get in touch with the electromagnetic driving plate 30 so that the electromagnetic driving plate 30 and the pendulum arm supporter 20 can be rotatingly adjusted by means of the contact of contact portions **42*a* and 44*b* with the electromagnetic driving plate 30** when the clock movement is inclined.

The seventh embodiment of the present invention is composed as mentioned above and its operation will be described hereinbelow.

In FIG. 16 shown therein is the state in which the clock movement is set right in the vertical direction, and it is evident that the pendulum arm 12 can swing in good condtions.

Figure 18:
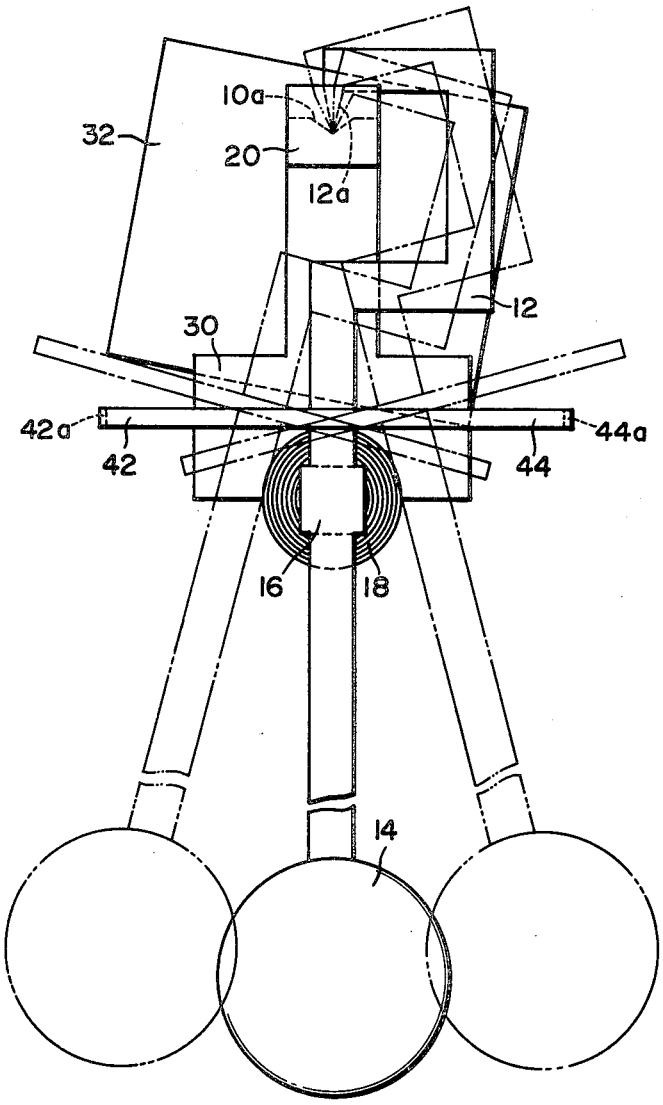
FIG. 18 is an illustration to describe the seventh embodiment.

FIG. 18 shows the state in which the clock movement 32 is set with inclination, and the pendulum arm supporter 20 and the electromagnetic driving plate 30 incline once together with the clock movement 32. When the pendulum arm 12 starts swinging from this state, the contact portion **42*a* of the contact arm 42 touches the electromagnetic driving plate 30 and the pendulum arm supporter 20 and the electromagnetic driving plate 30 rotate around the bearing hole 36 to be the center so that they are set right in the vertical direction. Accordingly, the pendulum arm supporter 20 can rotate and adjust its supporting position in accordance with the swinging position of the pendulum arm 12, and further, the electromagnetic driving plate 30 can rotate and adjust its electromagnetic coupling position in accordance with the swinging position of the pendulum arm 12**.

As described hereinabove, according to the seventh embodiment, in case the clock movement 32 is set with inclination, the supporting position of the pendulum arm 12 and the pendulum arm supporter 20, and the electromagnetic coupling position of the magnet 16 and the driving coil 18 can be rotatingly adjusted to perform swinging operation of the pendulum arm 12 in good conditions.

Figure 20:
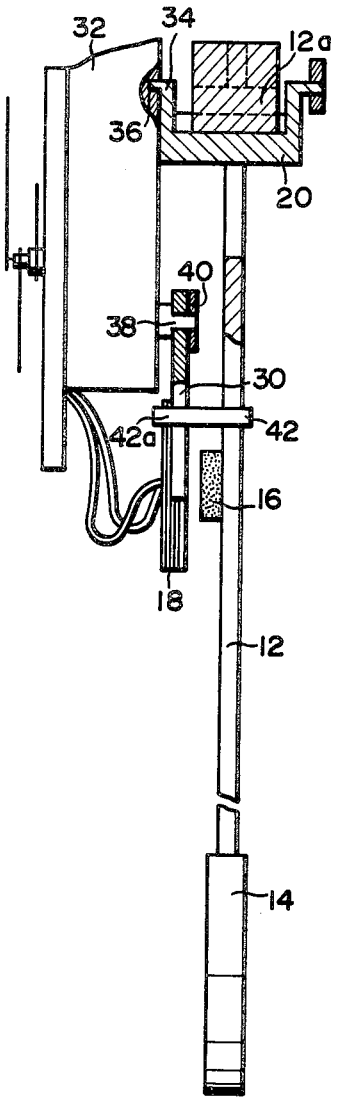
FIG. 20 is a sectional view taken on line 20—20 on FIG. 19.
Figure 19:
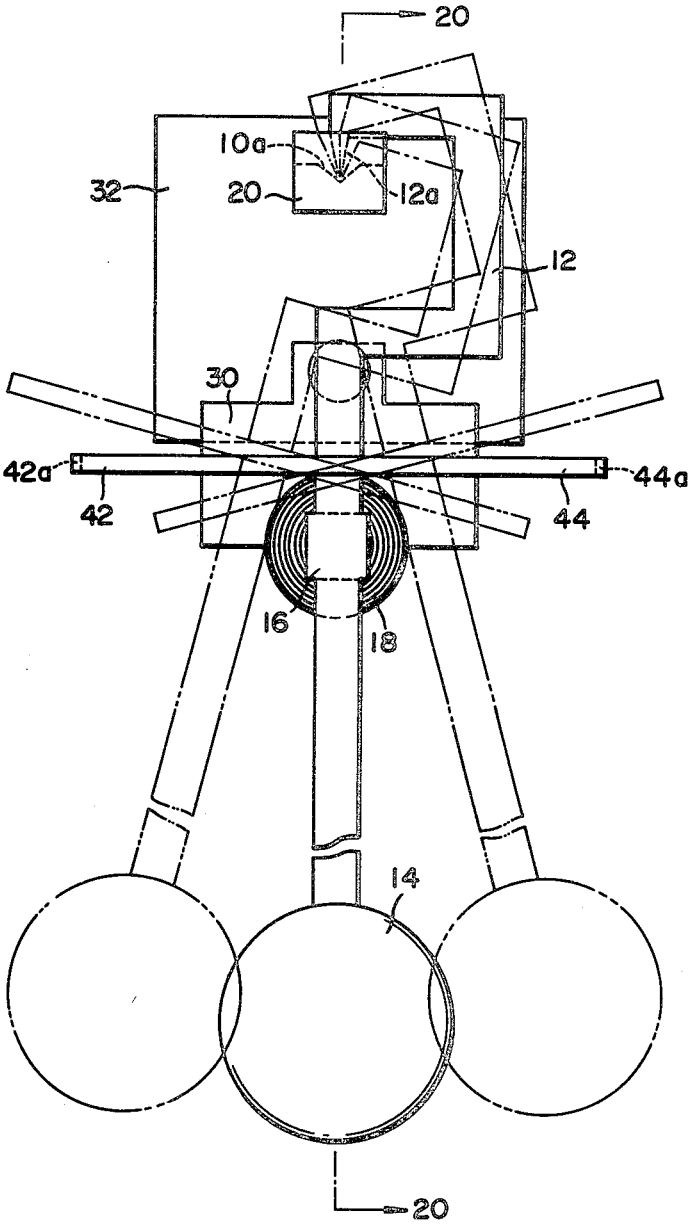
FIG. 19 is an illustration showing the eighth embodiment of the present invention.

In FIG. 19 shown therein is the eighth embodiment of the present invention, and FIG. 20 shows its sectional view.

In the eighth embodiment that the pendulum arm supporter 20 and the electromagnetic driving plate 30 are separately formed and are pivotally mounted with free rotation to the separate axis fulcrums of the clock movement 32.

Figure 21:
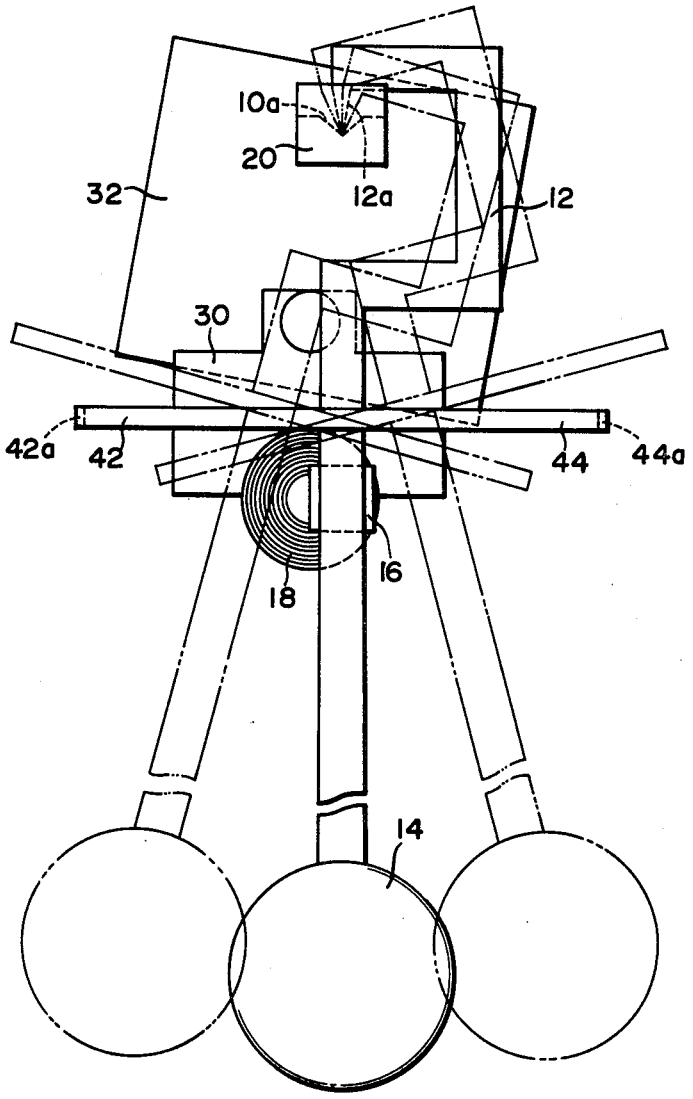
FIG. 21 is an illustration to describe the operation of the eighth embodiment.

In other words, the pendulum arm supporter 20 has the shaft 34 and the clock movement 32 has the bearing hole 36 which engages with the shaft 34 mentioned above. The pendulum arm supporter 20 can rotate to the bearing hole 36 by its own weight. Furthermore, the clock movement 32 has the shaft 38 and the electromagnetic driving plate 30 has the bearing hole 40 which engages with the shaft 38 mentioned above. The electromagnetic driving plate 30 can be rotated around the shaft 38 by the contact portions **42*a* and 44*a* of the contact arms 42 and 44 attached to the pendulum arm 12. Accordingly, in the eighth embodiment, when the clock movement 32 is set with inclination as shown in FIG. 21, the swinging position of the pendulum arm 12 and the pendulum arm supporter 20 and the electromagnetic coupling position of the magnet 16 and the driving coil 18** can be rotatingly adjusted.

As described heretofore, according to the embodiments, since the pendulum arm supporting means consists of the pendulum arm supporter which is pivotally mounted with free rotation on the clock movement housing and the electromagnet driving plate is pivotally mounted with free rotation against the clock movement, the pendulum arm supporter can be rotatingly adjusted its supporting position in accordance with the swinging position of the pendulum arm and the electromagnetic driving plate can be rotatingly adjusted its electromagnetic coupling position in accordance with the swinging position of the pendulum arm when the clock movement is set with the inclination. Accordingly, the swinging operation of the pendulum arm can be performed in good conditions when the clock movement is set with inclination.

Incidentally, in the above described fifth through eighth embodiments, since the supporting point of the pendulum arm 12 by the pendulum arm supporter 20 is prepared lower than its rotating center, that is, the bearing hole 36, the pendulum arm supporter 20 can be rotatingly adjusted with ease.

Since the rotating adjustment operation of the pendulum arm 20 is performed with larger torque than the swing driving force produced between the magnet 16 and the driving coil 18, the pendulum arm supporter 20 does not swing together with the pendulum arm 12.

Furthermore, in the above described fifth and seventh embodiments, since the pendulum arm supporter 20 and the electromagnet driving plate 30 are solidly molded, the electromagnetic driving plate 30 can be easily manufactured and the assembling process of the electromagnetic driving plate 30 to the clock movement can be omitted.

As described heretofore, according to the pendulum arrangement for the clock movement in accordance with the teachings of the present invention, since the pendulum arm supporter can be rotatingly adjusted its supporting position in accordance with the swinging position of the pendulum arm, and the electromagnetic driving plate can be rotatingly adjusted its electromagnetic coupling position, the pendulum arm cannot be limited its swinging angular amount, when clock movement is set with inclination, and the pendulum arm can swing without unstable or impossible swing.

Since the driving coil is always rotatingly adjusted to be placed on the swinging center of the pendulum arm, the pendulum arm can swing symmetrically to the left and the right for the driving coil to be centered, and, consequently, the passing amount of the magnet passing over the driving coil always becomes unified. The induced electromotive force in the driving coil, therefore, always stays fixed, and the swinging amount of the pendulum arm is always kept stable. The passing speed of the magnet overthe driving coil always stays fixed and the electric current in the driving coil does not increase.

As described heretofore, according to the present invention, the swinging operation of the pendulum arm can be always performed in good conditions even if the clock is hung with inclination.

What we claim is:

1. A pendulum arrangement for a clock movement in which said arrangement has a pendulum arm being mounted to swing freely at a pendulum arm supporting means which is installed on a clock movement housing, and said pendulum arm supporting means consists of a pendulum arm supporter which is pivotally held with free rotation on the clock movement housing so that the pendulum arm supporter can rotate and adjust its supporting position in accordance with the swinging state of the pendulum arm and the inclination of the clock movement, said pendulum arm supporter consisting of a V-shaped groove which receives a knife edge of the pendulum.

2. A pendulum arrangement for a clock movement according to claim 1, wherein said pendulum arm supporting means consists of a pendulum arm supporter which is pivotally mounted with free rotation on the clock movement housing, and the supporting point of said pendulum arm supporting means is prepared lower than the rotating center of said pendulum arm supporter so that said pendulum arm supporter can be rotatingly adjusted its supporting position in accordance with the swinging position of the pendulum arm .

3. A pendulum arrangement for a clock movement according to claim 1, wherein said arrangement includes a magnet which is fixed on the pendulum arm and a driving coil which is arranged facingly to said magnet in order to produce swing driving force to the pendulum arm by electromagnetic coupling with said magnet, and said swing driving coil is pivotally mounted with free rotation against the clock movement so that its electromagnetic coupling position can be rotatingly adjusted in accordance with the swinging position of the pendulum arm.

4. A pendulum arrangement for a clock movement according to claim 3, wherein said swing driving coil is fixed on the element which is extendingly formed downwards from said pendulum arm supporter.

* * * * *